US005192828A

United States Patent [19]

Austin et al.

[11] Patent Number: 5,192,828

[45] Date of Patent: Mar. 9, 1993

[54] DETONATING CORD AND BLASTING CAP CONNECTOR BLOCK HAVING A RESILIENT FREE END CORD LATCH

[75] Inventors: Dennis K. Austin, Simsbury; J. Donaldson Thomas, East Granby, both of Conn.

[73] Assignee: The Ensign-Bickford Company, Simsbury, Conn.

[21] Appl. No.: 851,045

[22] Filed: Mar. 13, 1992

[51] Int. Cl.[5] ..... F42B 3/26; C06C 5/00

[52] U.S. Cl. ..... 102/275.12; 102/275.4

[58] Field of Search ..... 102/275.12, 275.4, 275.2, 102/275.5, 275.7, 331, 304

[56] References Cited

U.S. PATENT DOCUMENTS

| | | | |
|---|---|---|---|
| 3,987,733 | 10/1976 | Spraggs et al. | 102/275.4 |
| 4,187,780 | 2/1980 | Petruccelli | 102/275.12 |
| 4,248,152 | 2/1981 | Yunan | 102/275.2 |
| 4,714,018 | 12/1987 | Löfgren | 102/275.12 |
| 4,821,645 | 4/1989 | Reiss | 102/275.7 |

OTHER PUBLICATIONS

CXA Promotional Literature.

*Primary Examiner*—David H. Brown

*Attorney, Agent, or Firm*—Hayes & Reinsmith

[57] ABSTRACT

An elongated connector block for mounting a blasting cap and detonating cord in side-by-side association for side initiation, the body having a generally U-shaped transverse cross-section with a slot extending the full length thereof, the opposed sides of said slot being contoured to receive the detonating cord and the body providing an enlarged, elongated cavity for receiving the blasting cap, there being an upward integral extension of at least one side of the body forming a pinch cleat for securing a flexible detonating cord in position by winding it about the pinch cleat, the space between the one pinch cleat extension and the body being provided with a flexible retainer clip extending from the body toward the pinch cleat underside, the leg of the clip having a rest position substantially closing the space between the body and the pinch cleat to retain the free end of the detonating cord after winding about the cleat.

3 Claims, 2 Drawing Sheets

DETONATING CORD AND BLASTING CAP CONNECTOR BLOCK HAVING A RESILIENT FREE END CORD LATCH

BRIEF SUMMARY OF THE INVENTION

This invention relates to surface connectors for blasting caps and detonating cords and is more particularly directed to certain improvements in U.S. Pat. No. 4,187,780 entitled "Detonating Cord Blasting Cap Connector Block", assigned to the assignee of the present invention and whose disclosure is incorporated herein by reference.

Certain techniques of use of the connector block of the prior art U.S. Pat. No. 4,187,780 patent created some use deficiencies. While most uses of the aforementioned prior art connector block admirably met the primary goal of establishing the connection of detonating cord and blasting cap without the use of tools, tape or cumbersome tying procedures, some conditions of use produced less than totally effective looping of the detonating cord in and around the block in operative relationship to the detonating cap positioned within the block while precluding unwanted detonating contact with shock tube connected to the detonating cap.

It is therefore a primary object of this invention to provide a connector block which snugly receives and retains a blasting cap, the signal transmission (usually shock tube) means connected to the cap and the detonating cord while safely and effectively positioning the detonating cord in a position remote from the signal transmission means and while maintaining a generally smooth exterior configuration.

It is a further object of this invention to provide a compact, easily manufactured low cost connector that is extremely durable and reliable in operation and that minimizes the opportunity for inadvertent misconnection or disconnection of the detonating cord from the connector block occasioned by rough handling while enhancing the likelihood of proper installation by the operator when installing under adverse weather conditions.

It is a still further object of this invention to provide a connector block for mounting a blasting cap and detonating cord in intimate side by side relationship wherein the connector block is provided with at least one cleat having a V-shaped groove for securing the detonating cord, at least that one cleat being provided with an integral spring finger disposed within the V-shaped groove as a detonating cord retainer.

It is an additional object to provide a connector block for mounting a blasting cap and detonating cord which block has a smooth exterior surface substantially free of projections precluding unwanted "snagging" while being comfortably and easily hand held.

Other objects will be in part obvious and in part pointed out in more detail hereinafter.

A better understanding of the objects, advantages, features, properties and relations of the invention will be obtained from the following detailed description and accompanying drawing which set forth certain illustrative embodiments and are indicative of the ways in which the principles of the invention are employed.

DESCRIPTION OF PRIOR ART AND A PREFERRED EMBODIMENT OF THE IMPROVEMENT

Figure 1:
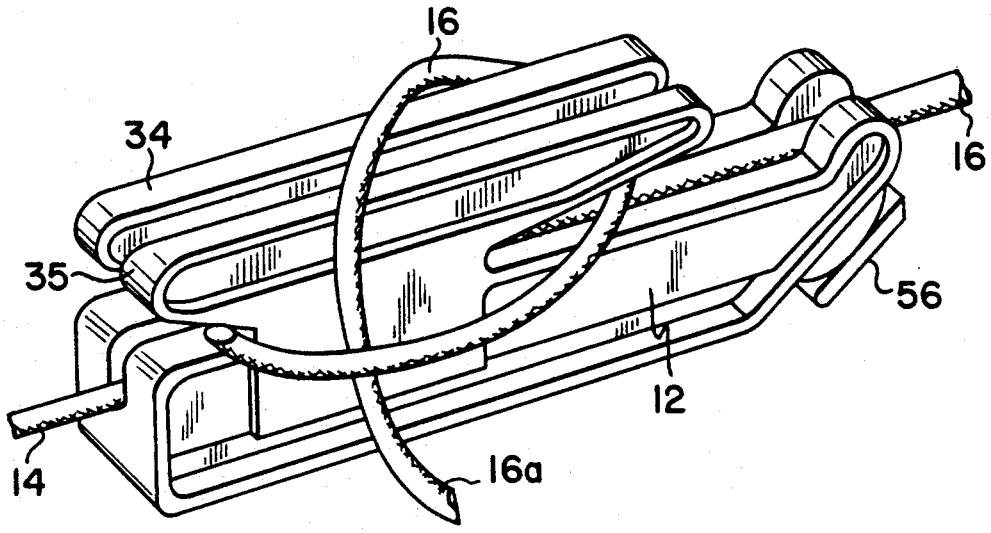
FIG. 1 PRIOR ART
FIG. 1 is a perspective view of the prior art device of U.S. Pat. No. 4,187,780 in use with detonating cord and blasting cap.

Referring now to the drawings in greater detail wherein FIG. 1 is an illustration of the prior art connector block of U.S. Pat. No. 4,187,780 assigned to the assignee of the present invention, the system of the aforementioned prior art patent generally comprises a pair of spaced connecting blocks or bodies 12 (one of which is illustrated) interconnected by a signal transmitting shock tube 14, a generally elongated cylindrical, signal amplifying blasting caps (not shown) disposed within a suitable cavity or passageway 38 in the body (see FIG. 4), the caps being connected to the ends of shock tube 14.

Detonating cord or fuse 16 may be for example the product sold by Ensign-Bickford Company under the trademark PRIMACORD. Also as noted in the U.S. Pat. No. 4,187,780, the blasting caps at the ends of the signal transmitting tube 14 may be signal delay caps and the general utility and advantages of a surface connector system are fully described in U.S. Pat. No. 3,987,733 assigned to the assignee of the present invention; hence it will not be further described here.

Figure 2:
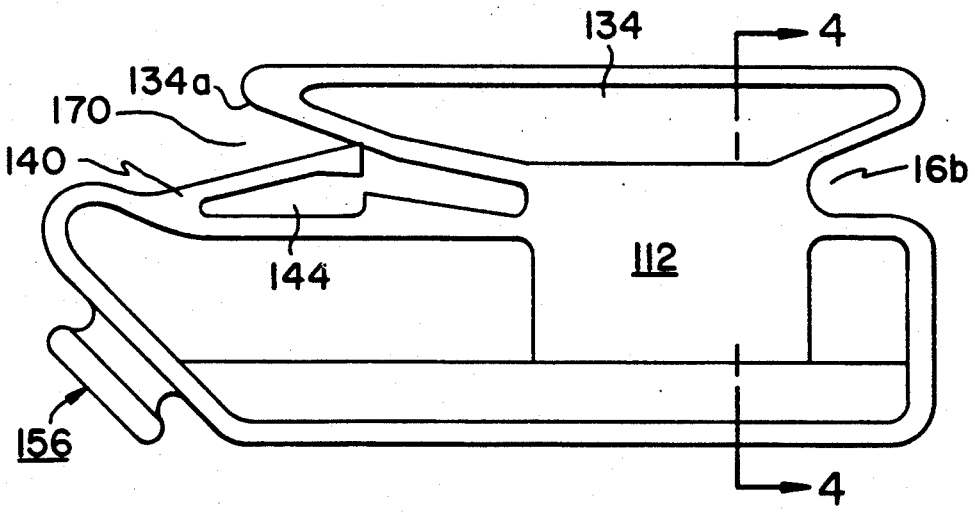
FIG. 2 is a side elevation view of the improved connector block of the present invention.

The block 12 of FIG. 1 and the block 112 of FIG. 2 are generally the same and each is a one piece molding which secures a detonating cap (not shown) in a suitable passageway 138 (see FIG. 4) and connected to shock tube 14, which shock tube 14 is wrapped about the knob chock 56 with the detonating cord 16 received between the sides 30 and 31 of the slot 26. The free end **16*a* (see FIG. 1) of the detonating cord is wrapped about the cleats 34, 35 and its free end 16*a* is intended to be looped under one wrap of cord 16**.

The present invention is directed to the provision of a new and improved detonating cord and blasting cap connector block 112 shown in FIG. 2. Block 112 is also preferably manufactured as a single piece of molded plastic of a suitable durable material such as high density polyethylene and having sufficient flexture to permit installation of a blasting cap (in the passageway 138, see FIG. 4) and yet having sufficient rigidity for securely retaining the detonating cord and the blasting cap.

The connector block 112 is shown as generally symmetrical about a longitudinally extending plane. An elongated lower body portion 124 of the block 112 has a lower central slot 126 (see FIG. 4) extending longitudinally the full length of the block 112 and a pair of opposed substantially identical sides 130, 131 on opposite sides of the slot 126 extending upwardly from a base 127. A pair of opposed substantially identical anvil-shaped cleat-like extensions 134, 135 extend upwardly from the sides 130, 131 respectively to form an upper longitudinally extending central slot 136 somewhat wider than the lower slot 126 and which provides for receiving a detonating cord 116 therebetween.

The sides 130, 131 are formed with inner opposed, partially cylindrical recesses or cavities 138, 139 extending longitudinally from a front end of the connector block body to a rear terminal end 142 short of the rear end 143 of the body 124. The opposed cavities 138, 139 together with the intermediate lower slot 126 form an elongated blasting cap cavity for manually inserting a blasting cap from the front end 140 of the connector block body 124 into the blasting cap cavity.

As in U.S. Pat. No. 4,187,780, the body 124 of the connector block 112 has relatively thin side walls along the base 127, sides 130, 131 and cleat-like extensions 134, 135 and a peripheral laterally outwardly projecting rim 150 is provided around the perimeter of each side. The respective cleat-like extensions 134, 135 which extend forwardly from the terminal end of the blasting cap cavity to encase the rear explosive end of the blasting cap.

Figure 4:
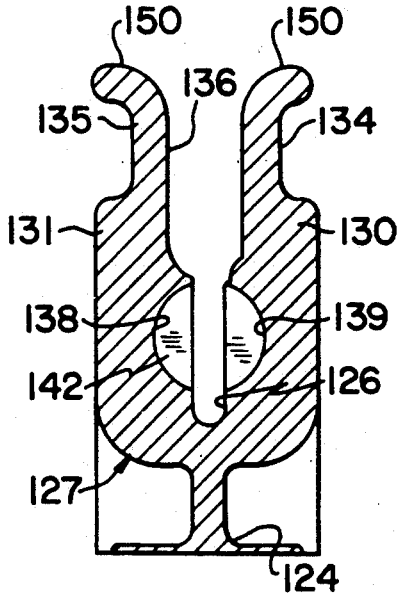
FIG. 4 is a cross-section view of the improved connector block taken along the lines 4—4 of FIG. 2.

As most clearly seen in FIG. 4, the lower central slot 126 extends above and below the blasting cap cavity and has a width for snuggly receiving the flexible signal transmitting tube 114 immediately below the passageway 138, 139 for blasting cap. Also, knob chock 156 is provided on the front downwardly inclined end of the connector block body for wrapping the flexible signal transmitting or shock tube 114 thereabout; accordingly, the signal transmitting tube and attached blasting cap are mounted as in U.S. Pat. No. 4,187,780.

After the shock tube 114 and blasting cap are installed as described, a detonating cord 116 may be readily placed in the connector block 112 by first placing the detonating cord 116 into the lower end of the upper slot 136. The rear free end of the detonating cord 116 is then wrapped around the pair of opposed cleats 134, 135 as shown. The rear end of the detonating cord 116 is thereby substantially retained within one of the rear generally V-shaped grooves 166 formed by the cleat extensions 134, 135. Similarly, the detonating cord 116 is also retained within the forward generally V-shaped grooves 170. For completeness, it is noted that the block of this invention can be fabricated with a single upstanding cleat.

As with the block of U.S. Pat. No. 4,187,780, it can be seen that the connector block 112 provides for enclosing and protecting the blasting cap.

A principle advantage found in the present invention is the provision of the spring latch member or fingers 140, 141 which are preferably molded integrally with connector block 112 and hence are slightly resilient. The throat 170 of cleats 134, 135 serve to retain the detonating cord as in the prior art except that it is unnecessary to loop the detonating cord end **16*a* (see FIG. 1) to retain it in position to prevent unintended release of the free end of the detonating cord. Spring finger 140, in its illustrated rest position of FIG. 2, engages the underside 134*a* of cleat 134 but is deflectable in a downward direction into the recess 144 to permit the sidewise insertion of detonating cord in the throat 170**.

Figure 3:
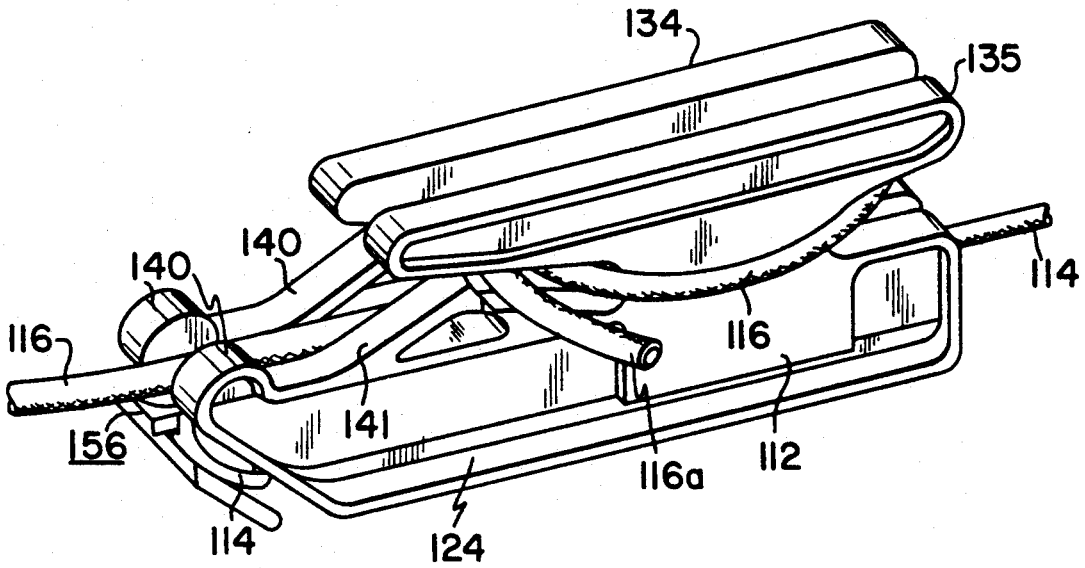
FIG. 3 is a perspective view showing the connector block of FIG. 2 with detonating cord wrapped in position.

In the preferred embodiment, a pair of such spring fingers 140, 141 as is shown in FIG. 3 are provided on each side of the slot just as there are provided two cleat members extending upwardly from the side walls of block body 112 to thereby doubly ensure retention of the detonating cord free end **116*a* in the desired position. The assembly of detonating cord 116, cap and shock tube 114 with connector block 112 of the present invention is clearly set forth in FIG. 3 and the cross section shown in FIG. 4 taken along the lines 4—4 of FIG. 2** shows a configuration much the same as that shown in prior art U.S. Pat. No. 4,187,780.

It is therefore seen that the present invention provides a low cost connector block which effectively secures all elements in position, protects the cord, shock tube and cap from the possible dislodgement from rough handling while at the same time enabling the user working in adverse environmental conditions of cold and wet to make proper connections with reliability. Additionally the present invention provides a generally smooth exterior configuration devoid of unwanted projections likely to become caught on environmental materials while at the same time being smooth and comfortable to the user's hand.

As will be apparent to persons skilled in the art, various modifications, adaptations and variations of the foregoing specific disclosure can be made without departing from the teachings of this invention.

We claim:

1. An elongated connector block for mounting an elongated blasting cap and a detonating cord in side-by-side association for side initiation, comprising a longitudinally extending body of generally U-shaped transverse cross section with an intermediate longitudinally extending slot the full length thereof and a pair of opposed sides forming the sides of the slot contoured to receive the detonating cord, said body providing an enlarged elongated blasting cap cavity extending longitudinally from a front end of the body along at least a portion of said slot, an upward integral extension of at least one side of the body forming a pinch-cleat for longitudinally positioning a flexible detonating cord along the slot in intimate parallel side-by-side association with and above a blasting cap inserted in said cavity and for retaining the detonating cord in said position by winding it about the pinch-cleat extension, the space between said one pinch-cleat extension and said body having a flexible retainer clip positioned therein for retaining the free end of the detonating cord after winding the cord about the cleat.

2. A connector blocking according to claim 1 wherein the sides of the body have generally flat aligned longitudinally extending top edges each supporting a pinch cleat, each said pinch-cleat side extension being anvil shaped with front and rear detonating cord retaining portions cooperating with the top edge of its respective side for locating and retaining the detonating cord therebetween and a flexible retainer clip extending from each side towards its respective pinch cleat, said clip being flexible to admit detonating cord but to limit withdrawal.

3. A connector block according to claim 1 wherein said retainer clip is formed integrally with and extends from said retainer clip being flexible and extending toward the base of the anvil so as to deflect to easily admit the detonating cord.

* * * * *